US006509885B1

(12) United States Patent
Hanaki et al.

(10) Patent No.: US 6,509,885 B1
(45) Date of Patent: Jan. 21, 2003

(54) DEVICE HAVING MULTIPLE LUMINESCENT SEGMENTS

(75) Inventors: Takashi Hanaki, Kariya (JP); Koji Ogusu, Kariya (JP); Shogo Kameyama, Chiryu (JP); Kiyohito Narita, Takahama (JP); Naoki Matsumoto, Aichi-gun (JP)

(73) Assignee: Denso Corporation, Kariya (JP)

( * ) Notice: Subject to any disclaimer, the term of this patent is extended or adjusted under 35 U.S.C. 154(b) by 246 days.

(21) Appl. No.: 09/630,809

(22) Filed: Aug. 2, 2000

(30) Foreign Application Priority Data

Aug. 4, 1999 (JP) ..... 11-221325
Sep. 3, 1999 (JP) ..... 11-250790
Jun. 14, 2000 (JP) ..... 2000-178787

(51) Int. Cl.[7] ..... G09G 3/30
(52) U.S. Cl. ..... 345/76; 345/77; 345/82
(58) Field of Search ..... 345/76, 77, 45, 345/89, 90, 92, 95, 98, 82, 211; 315/169.1, 169.3

(56) References Cited

U.S. PATENT DOCUMENTS 5,714,968 A * 2/1998 Ikeda ..... 345/77
5,923,309 A 7/1999 Ishizuka et al.

FOREIGN PATENT DOCUMENTS

JP 54-113299 9/1979
JP 10-222127 8/1998

* cited by examiner

*Primary Examiner*—Dennis-Doon Chow
(74) *Attorney, Agent, or Firm*—Law Offices of David G. Posz

(57) ABSTRACT

A segment-type electroluminescent display panel is driven by a driving circuit that supplies a constant current to each luminescent segment. The display panel includes plural luminescent segments each having a luminescent area different from one another. The plural segments are grouped into several groups, so that each group includes the segments having the same or similar luminescent area. The amount of current to be supplied to each segment is determined group by group so that a substantially same current density is supplied to all the segments. Since the plural segments are grouped according to their size, the driving circuit is simplified while attaining an equal luminance among all the luminescent segments. Alternatively, an equal amount of current is supplied to all the variously sized segments, and a resistor is connected in parallel to each segment to equalize the current density supplied to each segment thereby to achieve an equal luminance among all the segments.

9 Claims, 12 Drawing Sheets

DEVICE HAVING MULTIPLE LUMINESCENT SEGMENTS

CROSS-REFERENCE TO RELATED APPLICATIONS

This application is based upon and claims benefit of priority of Japanese Patent Applications No. Hei-11-221325 filed on Aug. 4, 1999, No. Hei-11-250790 filed on Sep. 3, 1999, and No. 2000-178787 filed on Jun. 14, 2000, the contents of which are incorporated herein by reference.

BACKGROUND OF THE INVENTION

1. Field of the Invention

The present invention relates to a display device that has a self-luminescent display panel, such as an organic electroluminescent display panel, and more particularly to such a display panel having plural luminescent segments or sections.

2. Description of Related Art

A display device having an organic electroluminescent panel is generally known. En example of this kind of display device is disclosed in JP-A-10-222127. The display device disclosed therein has a dot-matrix-type organic electroluminescent panel. It is also known that luminance, or brightness of a picture element is substantially proportional to electric current supplied thereto. Therefore, the display panel is usually driven with constant current.

As opposed to the dot-matrix type organic electroluminescent display panel, a segment-type display panel usually includes plural luminescent segments, a luminescent area of which is different from each other. Accordingly, it is necessary to drive each segment with an amount of current proportional to its luminescent area to obtain uniform luminance among plural segments. In other words, it is necessary to supply an equal current density to each segment. If a number of current setters, each corresponding to each luminescent segment, are provided in a device for obtaining the uniform luminance, the device becomes complex and costly.

SUMMARY OF THE INVENTION

The present invention has been made in view of the above-mentioned problem, and an object of the present invention is to provide an improved display device in which a uniform luminance among plural luminescent segments or elements is realized without making the device complex and costly.

The display device is composed of a display panel having plural luminescent elements or segments, such as organic electroluminescent elements, and a driving circuit for supplying current to the elements. The driving circuit may be an integrated circuit (an IC circuit). The plural luminescent elements are grouped into several groups or sections, so that only the elements having the same or similar luminescent area belong to a given group. A circuit for setting an amount of current to be supplied to the elements is provided for each group. The amount of the current is set substantially in proportion to the luminescent area of the elements belonging to that group by selecting a resistance value of a variable resistor connected to the current setting circuit, or by setting a voltage of a voltage setter connected thereto. The current supply circuit may be composed of a push-pull circuit consisting of two transistors. Thus, the current density supplied to each luminescent elements is substantially all equal, and accordingly an equal and uniform luminance among all the elements is realized.

In case the luminescent elements, the luminescent area of which is similar to but somewhat different from one another, belong to a group or section, a current supply duty ratio for each element is adjusted according to the luminescent area of the element. In this manner, an equal luminance among the elements is attained though the same amount of current is supplied to all the elements in that group.

Alternatively, a resistor may be connected in parallel to each luminescent segment having the luminescent area different from one another. The resistance value of the parallel resistor is determined to equalize the current density supplied to all the segments. In this manner, an equal luminance among all the segments can be realized even when the same amount of current is supplied to the parallel circuit composed of the luminescent segment and the resistor. Auxiliary luminescent segments may be used in place of the parallel resistors. The size of the auxiliary segments is determined to equalize the current density supplied to the luminescent segments. In this case, the segments for displaying images are disposed in a display region of the panel while the auxiliary segments are disposed outside the display region.

According to the present invention, the current supply circuit in the display device is simplified by grouping the elements and thereby reducing the number of the current amount setters, while achieving an equal luminance among all the luminescent elements.

Other objects and features of the present invention will become more readily apparent from a better understanding of the preferred embodiments described below with reference to the following drawings.

DETAILED DESCRIPTION OF THE PREFERRED EMBODIMENTS

Figure 1:
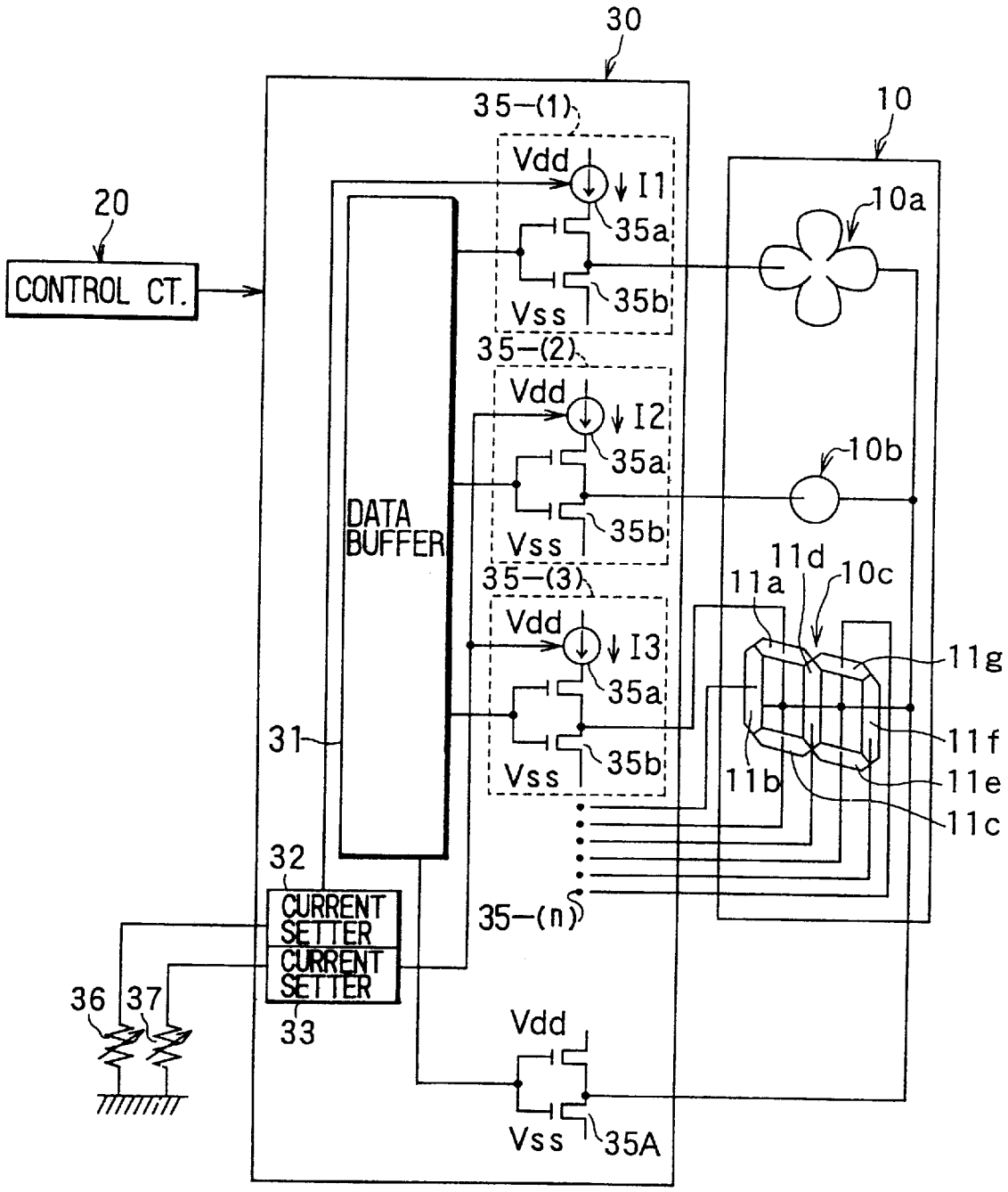
FIG. 1 is a circuit diagram showing an entire structure of a display device as a first embodiment of the present invention.

A first embodiment of the present invention will be described with reference to FIGS. 1–4. First, referring to FIG. 1, the entire structure of a display device will be described. The display device is composed of a segment-type organic electroluminescent display panel 10, a driving circuit 30 (an integrated circuit) for driving the display panel, a control circuit 20 (an integrated circuit) for controlling operation of the driving circuit, and variable resistors 36, 37 for setting current to be supplied to the display panel.

The display panel 10 includes a propeller-shaped luminescent segment 10*a*, a round luminescent segment 10*b* and a luminescent segment 10*c* having seven elements 11*a*–11*g* for displaying digits. Each luminescent segment is made of a luminescent layer sandwiched between positive and negative electrodes through which electric current is supplied to make the segment emit light. The luminescent area of the segment 10*a* is different from that of the segment 10*b*, and the luminescent area of the segment 10*b* is substantially equal to each luminescent area of the luminescent elements 11*a*–11*g* of the segment 10*c*. The segments 10*a*, 10*b* and elements 11*a*–11*g* of the segment 10*c* constitute picture elements, respectively.

The control circuit 20 outputs a control signal for selecting picture elements to be activated to emit light and signals for controlling the driving circuit 30 including shift-lock, latch, enabling, reset signals. Those output signals are fed to the driving circuit 30.

The driving circuit 30 includes a data buffer 31, two current setters 32, 33, plural current supply circuits 35-(1) to 35-(n), and a common push-pull circuit 35A. The data buffer 31 drives each current supply circuit in synchronism with control signals, such as the latch signal, which are output when picture element selecting signals corresponding to several picture elements are fed from the control circuit 20.

The current setters 32, 33, each composed of a current miller circuit and a circuit controlling current based on a standard voltage, set an amount of current to be supplied to each picture element through each current supply circuit. More particularly, the current setter 32 sets an amount of current to be supplied to the segments 10*a* through the current supply circuit 35-(1), based on a resistance set by the variable resistor 36. Similarly, the current setter 33 sets an amount of current to be supplied to the segment 10*b* through the current supply circuit 35-(2) and to be supplied to elements 11*a*–11*g* of the segment 10*c* through respective current supply circuits 35-(3) to 35-(n), based on a resistance set by the variable resistor 37. In this particular embodiment shown in FIG. 1, the number of current supply circuit is 9 (n=9). The variable resistors 36, 37 may be replaced with plural resistors that are selectively used.

Figure 2:
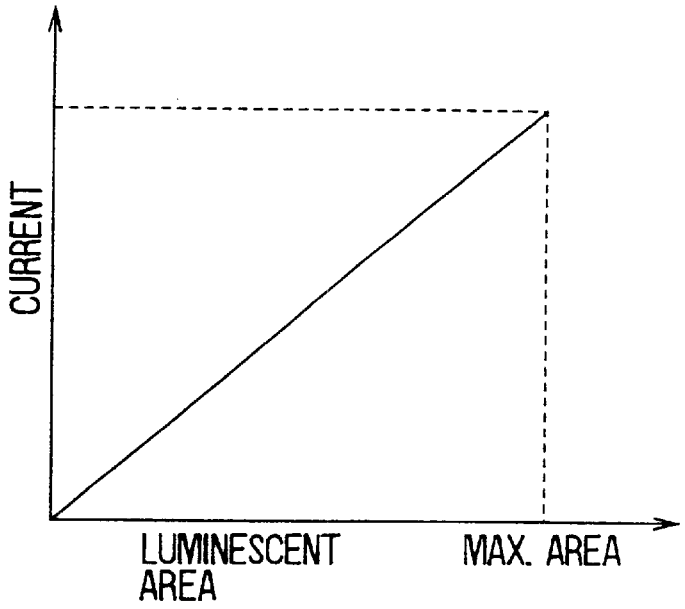
FIG. 2 is a graph showing a relation between a luminescent area of a segment and current required to drive the segment.
Figure 3:
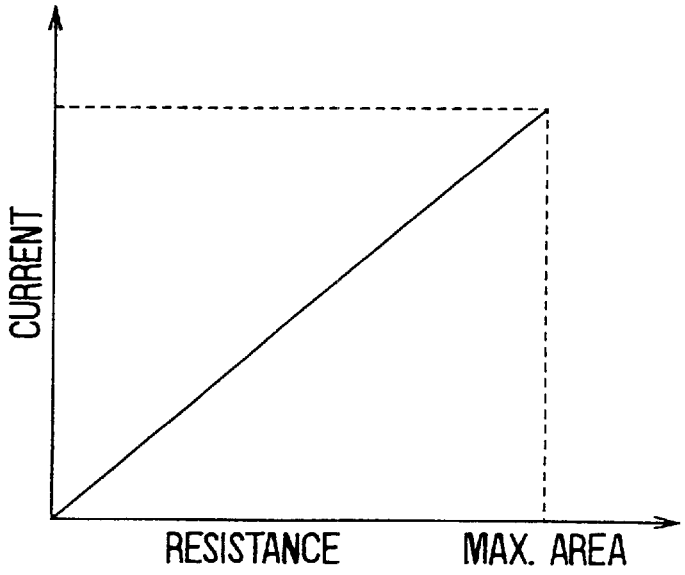
FIG. 3 is a graph showing a relation between a set resistance and current supplied to a segment.

The amount of current to be supplied to respective picture elements is determined according to the luminescent area of respective picture elements, as shown in FIG. 2. In other words, the set amount of current is proportional to the luminescent area of each picture element. This is because luminance, or brightness, of the organic electroluminescent elements is determined by current density supplied thereto and is proportional to the current density. In order to obtain an equal luminance among plural picture elements, it is necessary to supply an equal current density to all the picture elements. Each resistance level of the variable resistors 36, 37 is set according to the current to be supplied, which is proportional to the luminescent area, as shown in FIG. 3.

Figure 4:
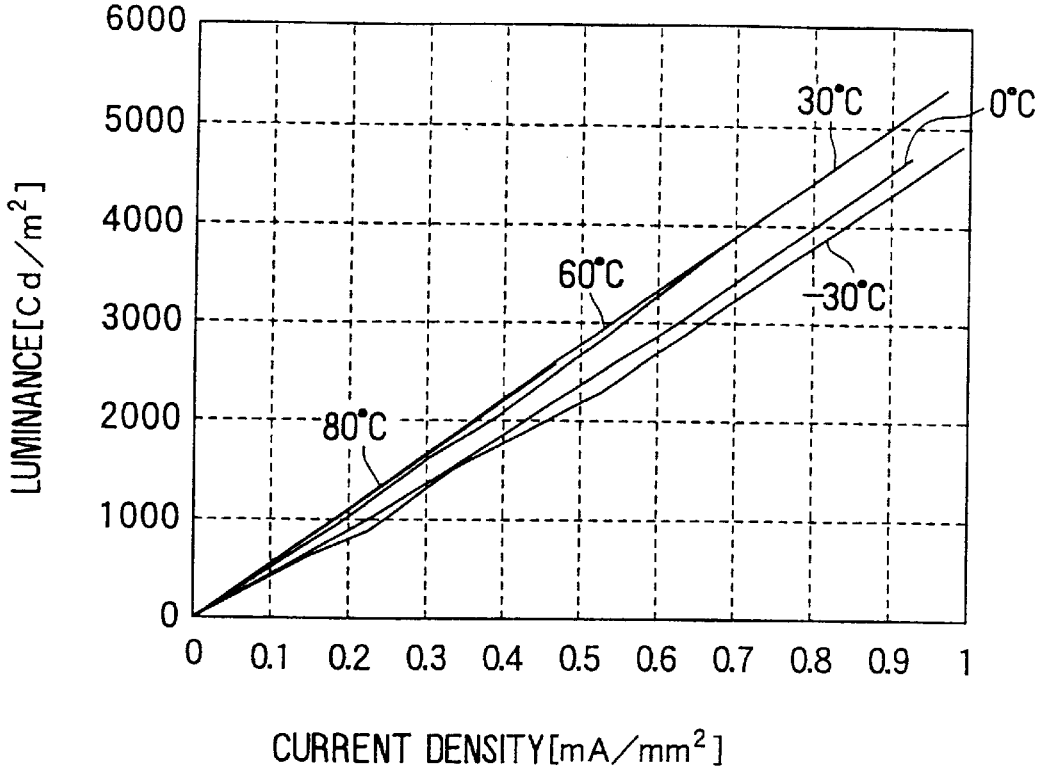
FIG. 4 is a graph showing a relation between a current density supplied to a segment and luminance of the segment, taking ambient temperature as a parameter.

To achieve a picture element luminance of 400 cd/mm$^2$, at least a current density of 0.1 mA/mm$^2$ is required, as seen from the graph shown in FIG. 4. Considering the characteristic deviation among the display panels, the minimum current density is set at 0.2 mA/mm$^2$ in this embodiment. Because the largest luminescent area of the picture element in this embodiment is 50 mm$^2$, at least 10 mA has to be supplied to that picture element.

Referring to FIG. 1 again, the current supply circuit 35-(1) is composed of a push-pull circuit 35*b* consisting of two FETs and a constant current source 35*a*. The constant current source 35*a* supplies the amount of current set by the current setter 32 to the push-pull circuit 35*b*. The push-pull circuit 35*b* supplies a constant current to the segment 10*a* under the synchronous control of data buffer 31. Similarly, the current supply circuit 35-(2) composed of the push-pull circuit 35*b* and the constant current source 35*a* supplies the current set by the current setter 33 to the segment 10*b*. In the same manner, the current supply circuits 35-(3) to 35-(n), each composed of the push-pull circuit 35*b* and the constant current source 35*a*, supply the current set by the current setter 33 to the luminescent elements 11*a*–11*g* of the segment 10*c*, respectively.

Each push-pull circuit 35*b* supplies the current to the respective picture element from its push-side, i.e., from its source side. The push-pull circuit 35*b* also constitutes a sink, at its pull-side, that supplies a reverse current to the picture element to delay deterioration of the same. Since the current is alternately supplied to the picture elements in both forward and backward directions, the common push-pull circuit 35A connected between the data buffer 31 and the negative electrodes is switched, so that its Vss side is turned off when the picture elements emit light and its Vdd side is turned off when the picture elements do not emit light.

The switching frequency in the forward and backward directions and the duty ratio for supplying the current are determined at a most appropriate levels, taking into consideration the image flicker, luminance and a life of the display panel 10. If the switching frequency is lower than 50 Hz, the image flicker appears on the panel, while if the switching frequency is unnecessarily high, the display device becomes complex and costly because the transmission speed of the control signals and selecting signals of the controller 20 have to be increased. Therefore, the switching frequency is set in a range between 50 Hz and 1,000 Hz. If the duty ratio (ON-duty) is low, a high current has to be supplied to a picture element to obtain a required level of luminance. To limit the maximum current to a level that is not detrimental to the picture elements, a minimum duty ratio has to be maintained. Further, if the duty ratio is too low, i.e., OFF-duty (a period in which a backward current is supplied to the picture element) is too high, prevention of the panel deterioration is not properly performed. Therefore, the minimum duty ratio has to be maintained for this reason, too.

As described above, the segment 10*b* and the elements 11*a*–11*g* in the segment 10*c* have the substantially same luminescent area, and the segment and elements are grouped into a second luminescent section and are separated from a first section consisting of only one segment 10*a* having a luminescent area different from that of the segment and elements in the second section. The first section is driven with the amount of current set by the current setter 32 to correspond to the luminescent area of the segment 10*a*, while the second section is driven with the other amount of current set by the current setter 33 to correspond to the luminescent area common to the segment 10*b* and elements 11*a*–11*g*. Therefore, substantially the same current density is supplied to all the picture elements, thereby achieving a substantially equal and uniform luminance among all the picture elements.

Moreover, the current setter 33 is common to eight picture elements, i.e., the segment 10*b* and elements 11*a*–11*g* of the segment 10*c*. In other words, only two current setters 32 and 33 are used. in this embodiment, without providing the number of current setters corresponding to the number of the picture elements. Accordingly, the display device as a whole, including the controller 20 and the driving circuit 30, is simplified and can be manufactured at a low cost.

FIG. 4, shows a relation between the current density supplied to the picture element and its luminance measured under various ambient temperatures. It is seen that the luminance is determined substantially by the current density without heavily affected by the ambient temperature. In other words, it can be said that the equal luminance among the picture elements can be obtained, without being much affected by the ambient temperature, by supplying the same current density to the picture elements.

Figure 6:
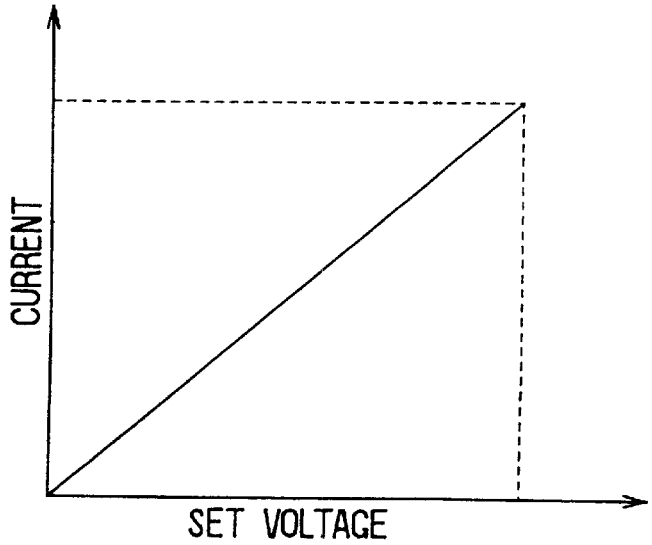
FIG. 6 is a graph showing a relation between a set voltage and current supplied to a segment.
Figure 5:
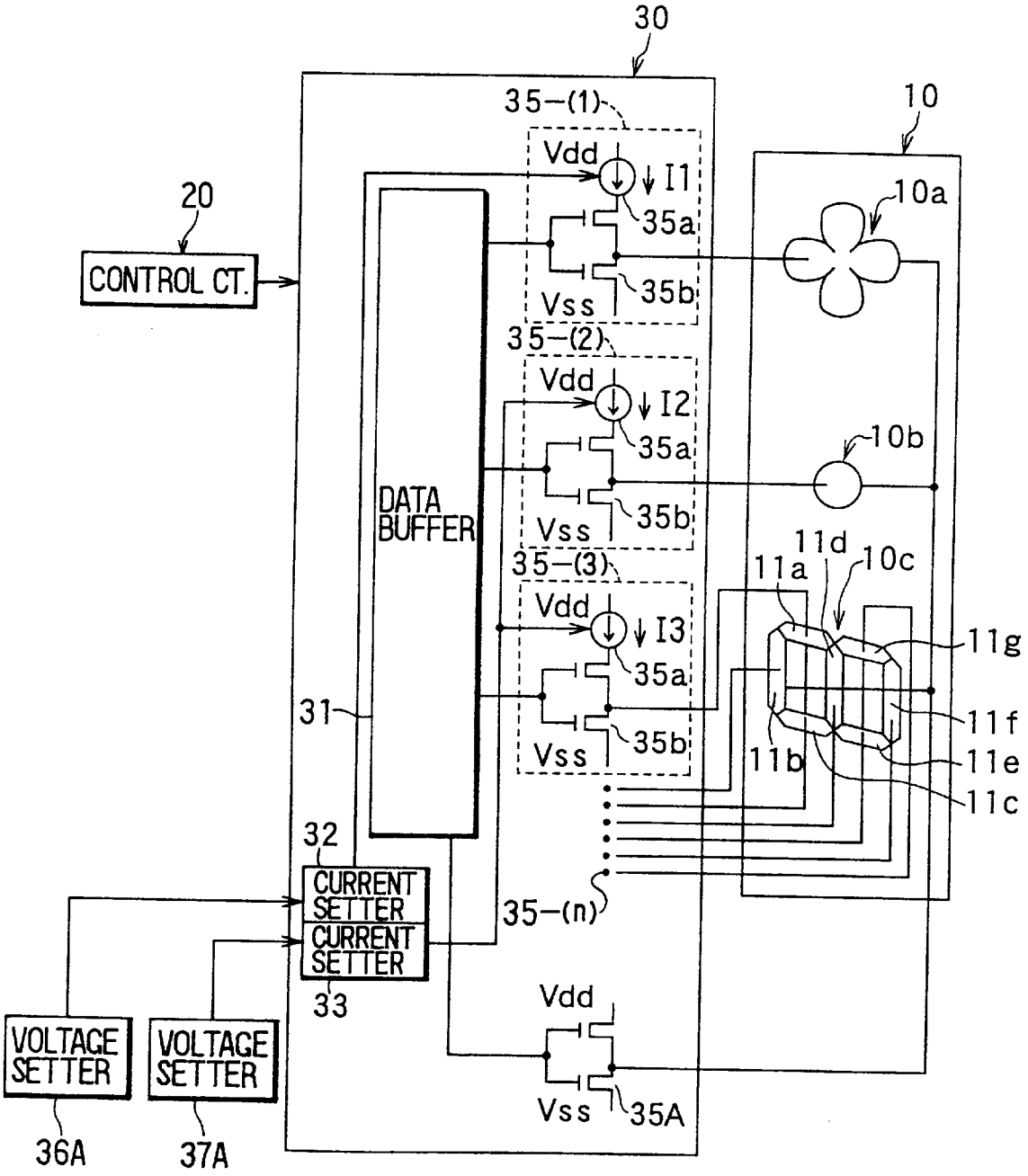
FIG. 5 is a circuit diagram showing an entire structure of a display device as a second embodiment of the present invention.

A second embodiment of the present invention will be described with reference to FIGS. 5 and 6. FIG. 5 shows an entire structure of the display device as the second embodiment of the present invention, in which the variable resistors 36 and 37 shown in FIG. 1 are replaced with voltage setters 36A and 37A. Each voltage setter 36A, 37A is composed of a voltage divider circuit or a Zener diode, and the constant current is set in the current setters 32, 33 based on the voltage set by the respective voltage setters 36A, 37A. The constant current to be supplied to the first luminescent section consisting of the segment 10*a* is set by the current setter 32 according to a voltage set by the voltage setter 36A. The constant current to be supplied to the second luminescent section consisting of the segment 10*b* and the elements 11*a*–11*g* of the segment 10*c* is set by the current setter 33 according to a voltage set by the voltage setter 37A. As shown in FIG. 6, the amount of the current set by the current setters 32, 33 is proportional to the voltage level set by the voltage setters 36A, 37A.

The second embodiment operates in the same manner as the first embodiment. The substantially equal current density is supplied to all the picture elements, i.e., the segment 10*a* in the first luminescent section and segments 10*b* and elements 11*a*–11*g* in the second luminescent section in the same manner as in the first embodiment, achieving the substantially equal luminance among all the picture elements.

A third embodiment of the present invention will be described with reference to FIGS. 7–12. In this embodiment, too, all the picture elements in the display panel are grouped into four luminescent sections, so that picture elements having a similar luminescent area belong to the same section. In this particular embodiment shown in FIG. 7, the picture elements 12*a*–12*e* having a similar but somewhat different luminescent area are grouped into the second section. In order to obtain an equal luminance among the picture elements 12*a*–12*e* in the second section, the duty ratio for supplying current to those elements is controlled in proportion to the respective luminescent areas.

Figure 11:
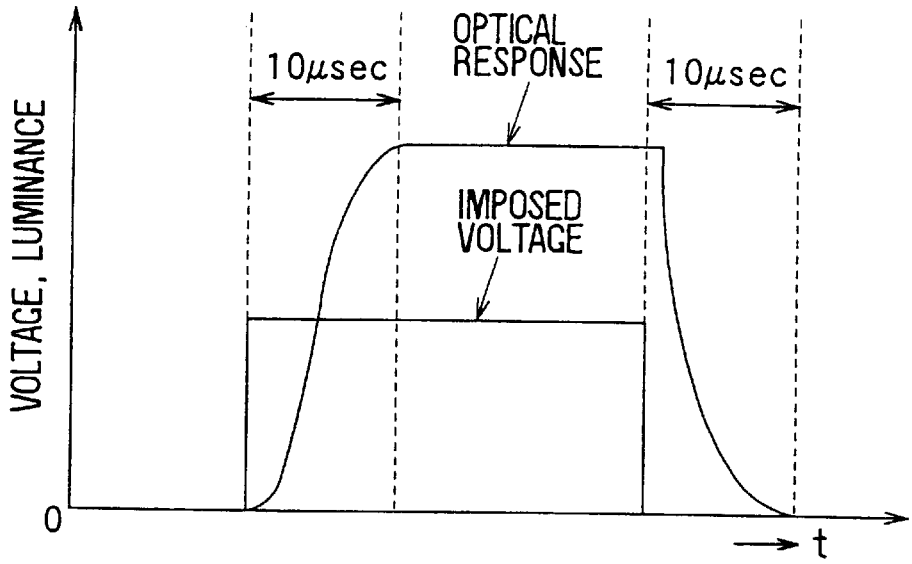
FIG. 11 is a graph showing an imposed voltage and a luminance of a segment versus time lapsed.
Figure 12:
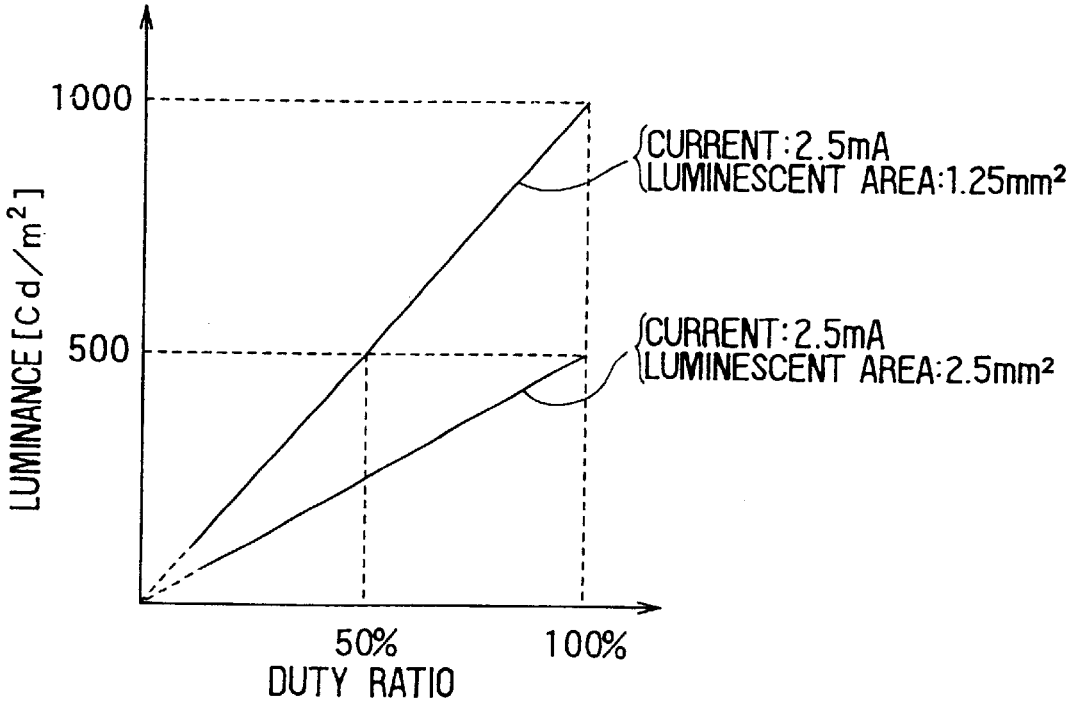
FIG. 12 is a graph showing a relation between a duty ratio of a supplied current and luminance of a segment, taking current and a luminescent area as parameters.

First, referring to FIGS. 11 and 12, the relation between the duty ratio and the luminance of the picture element will be explained. FIG. 11 shows a waveform of a pulse voltage imposed on a picture element and a luminance curve of the picture element. The luminance curve (an optical response) gradually rises up during 10 μsec after the pulse voltage is imposed and gradually decreases in 10 μsec after the pulse voltage disappears. This suggests that a duration of the highest luminance is proportional to the pulse width (the ON-duty of the imposed voltage), though the optical response is delayed from the imposed voltage by about 10 μsec. In other words, it is suggested that the luminance is substantially proportional to the duty ratio of the imposed pulse voltage. To confirm this relation, the luminance versus the duty ratio is measured and plotted in the graph of FIG. 12. It is seen from the graph that the luminance is substantially proportional to the duty ratio. It is also understood that an equal luminance among the picture elements having luminescent areas different from each other can be obtained by supplying the same level of current with a duty ratio that is proportional to the respective luminescent areas.

Figure 7:
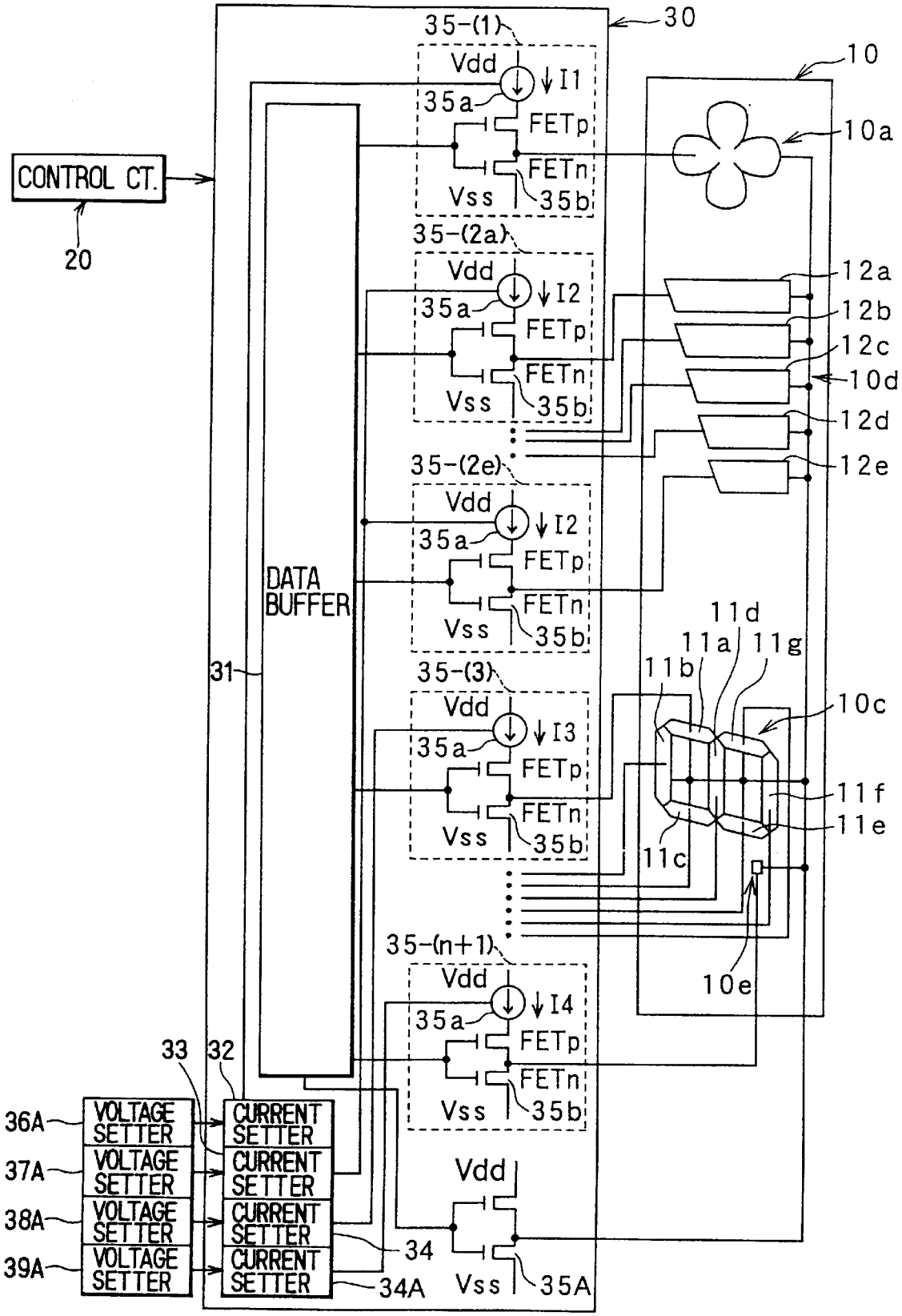
FIG. 7 is a circuit diagram showing an entire structure of a display device as a third embodiment of the present invention.

FIG. 7 shows the third embodiment of the present invention in which the idea mentioned above is realized. The segment 10*b* of the first embodiment is replaced with a segment 10*d* consisting of five luminescent elements each having a luminescent area slightly different from one another. A small single segment 10*e* for showing a dot is added to the first embodiment. All those picture elements are grouped into four sections, the first section consisting of the segment 10*a*, the second section consisting of the segment 10*d* that includes five elements 12*a*–12*e*, the third section consisting of the segment 10*c* that includes seven elements 11*a*–11*g*, and the fourth section consisting of the single small segment 10*e*. All the picture elements in four sections are driven by respective driving circuits 35-(1), 35-(2*a*) to 35-(2*e*), 35-(3) to 35-(n) and 35-(n+1).

A first amount of current $I_1$ is set by the current setter 32 based on a voltage set by the voltage setter 36A and is supplied to the segment 10*a* in the first section. A second amount of current $I_2$ is set by the current setter 33 based on a voltage set by the voltage setter 37A and is supplied to each element 12*a*–12*e* in the second section. A third amount of current $I_3$ is set by the current setter 34 based on a voltage set by the voltage setter 38A and is supplied to each element 11*a*–11*g* in the third section. A fourth current $I_4$ is set by the voltage setter 34A based on a voltage set by the voltage setter 39A and is supplied to the single segment 10*e* in the fourth section. All of those current are supplied to the respective picture elements through the respective push-pull circuits 35*b*, each consisting of an FETp and an FETn. The negative electrodes of the respective picture elements are connected to the common push-pull circuit 35A in the same manner as in the first embodiment.

Figure 8:
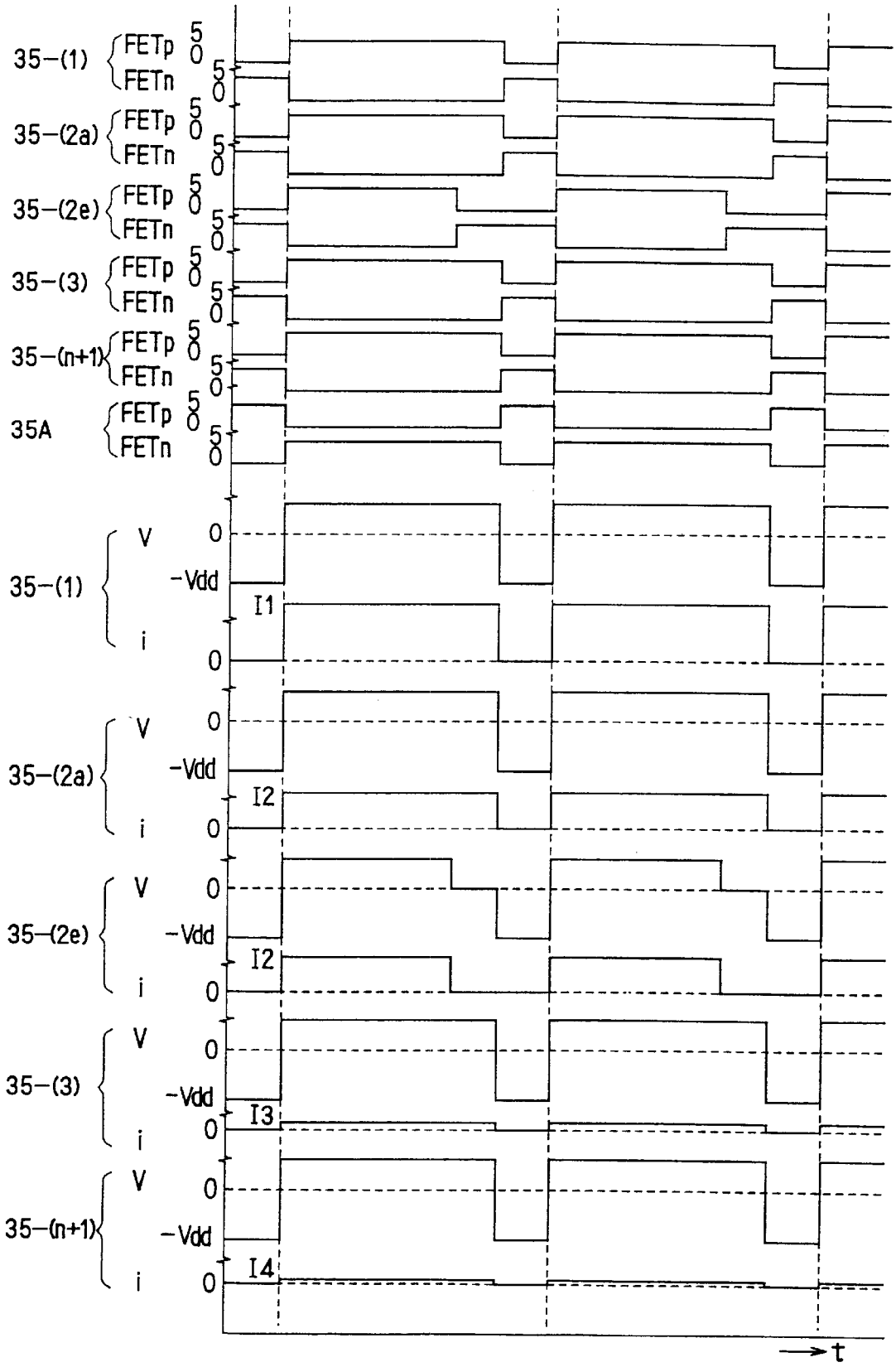
FIG. 8 is a timing chart showing operation of current supply sources and waveforms of current and voltage supplied to each segment in the third embodiment.

FIG. 8 shows operation of each driving circuit and waveforms of the voltage and the current supplied to each picture element in a timing chart form. The driving circuits 35-(1) to 35-(n+1) supply the current $I_1$ to $I_4$, respectively, as shown in the bottom part of the timing chart.

Figure 9:
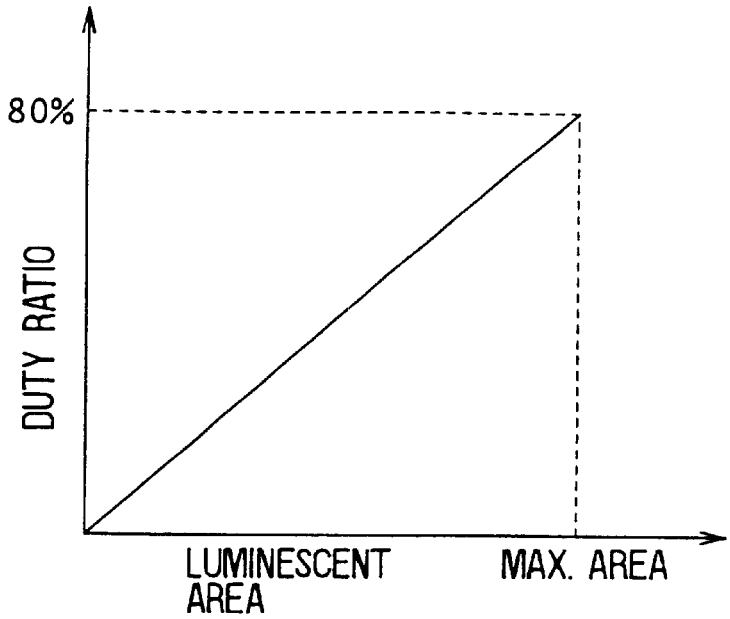
FIG. 9 is a graph showing a relation between a luminescent area of a segment and a duty ratio of current supplied to the segment.

The duty ratio for driving the picture elements is set in proportion to the respective luminescent areas as shown in the graph of FIG. 9. The highest duty ratio corresponding to the largest picture element is set to 80% because 20% has to,be used for imposing a reverse voltage to the picture element. The current $I_2$ supplied to the elements 12*a*–12*e* in the second section is set to a level common to those elements, but the duty ratio is set in proportion to the luminescent area of each element. Since the luminescent area difference among the elements 12*a*–12*e* is not too large, it is not necessary to set the respective duty ratios much differently from one another. In other words, the lowest duty ratio can be set to a reasonably high level. Therefore, it is not required to increase the driving voltage in employing the duty-ratio-controlled drive.

The current density supplied to the segment 10*a*, the largest element 12*a* in the segment 10*d,* the elements 11*a*–11*g* in the segment 10*c* and the segment 10*e* is substantially the same. The duty ratio of the current supplied to elements 12*a*–12*e* in the segment 10*d* is controlled to equalize the luminance. Therefore, the luminance of all the picture elements in four luminescent sections becomes substantially equal, and a uniform display brightness is realized in the electroluminescent panel 10 as a whole.

Figure 10:
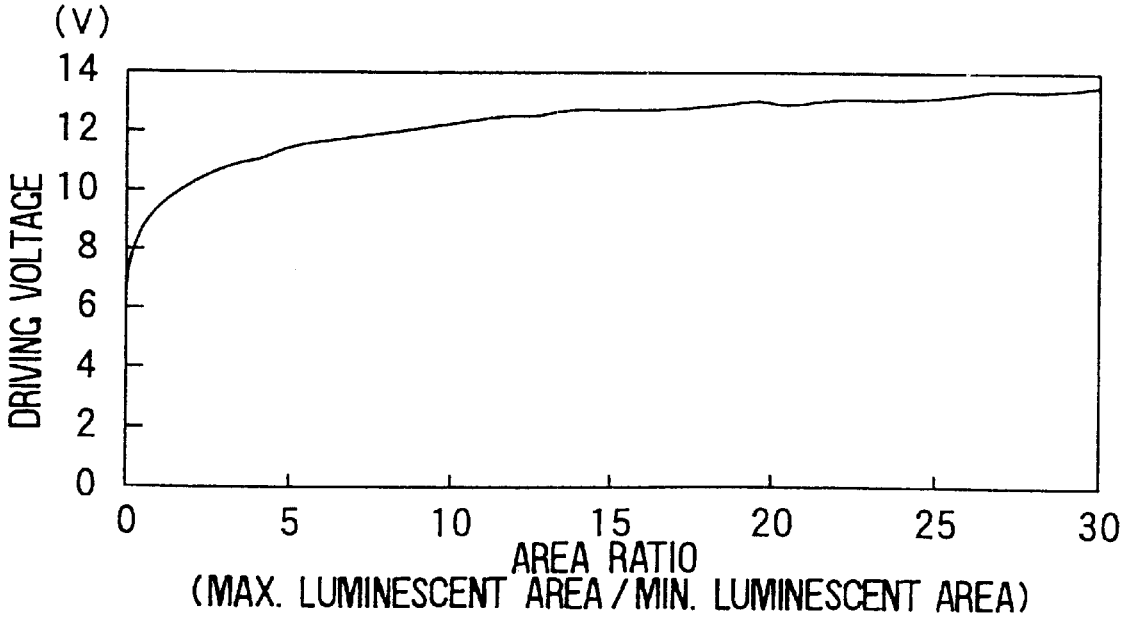
FIG. 10 is a graph showing a relation between a ratio of a maximum luminescent area to a minimum luminescent area and driving voltage.

If all the picture elements having a luminescent area different from one another are driven only by controlling the duty ratio in proportion to the luminescent area without grouping the elements having a similar luminescent area, the luminescent area ratio between the largest and the smallest picture elements becomes considerably large. The luminescent area ratio (the largest luminescent area/the smallest luminescent area) can be 30, for example. FIG. 10 shows a relation between the driving voltage required to drive the elements and the luminescent area ratio. When the luminescent area ratio is 30, the driving voltage required is 13 V which is higher than 12 V of a usual on-board battery. This means a voltage booster is necessary to drive the display panel. By grouping the picture elements into sections as in the embodiment described above, the luminescent area ratio in a section can be kept small, and the display panel can be driven by the battery voltage without providing a voltage booster.

A display device as a fourth embodiment of the present invention will be described with reference to FIGS. 13 and 14. The display device is composed of a segment-type organic electroluminescent display panel 40 and a constant current driving circuit 50. The display panel 40 includes three segments 41, 42 and 43. These segments are all rectangular-shaped, and their luminescent areas are S1, S2 and S3, respectively, where S2=S1/2 and S3=S1/4. The shape of the respective segments could be a shape other than rectangular. The same constant current "i" is supplied to three segments 41, 42, 43, respectively, from the driving circuit 50.

Figure 13:
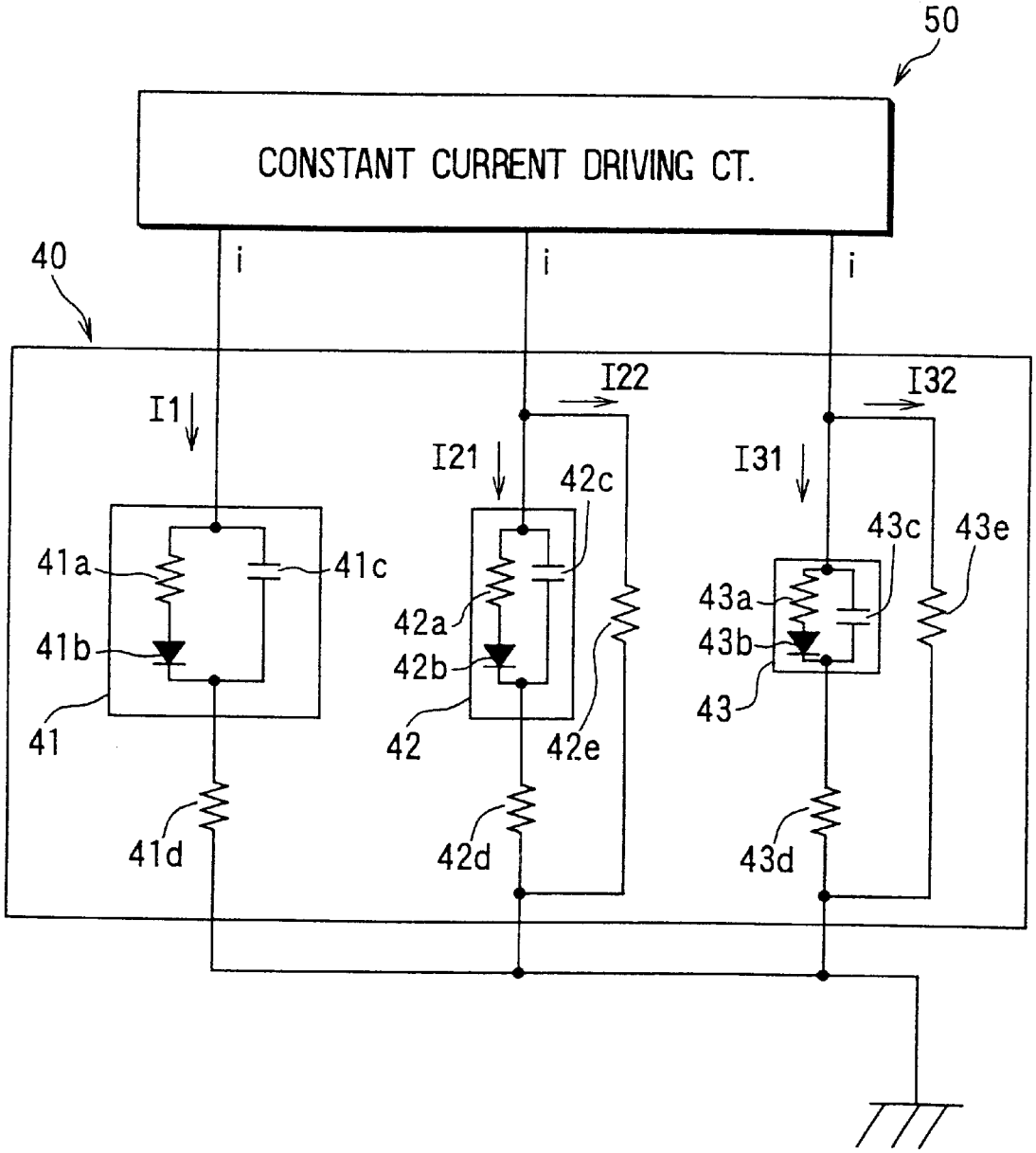
FIG. 13 is a circuit diagram showing a display device as a fourth embodiment of the present invention.
Figure 14:
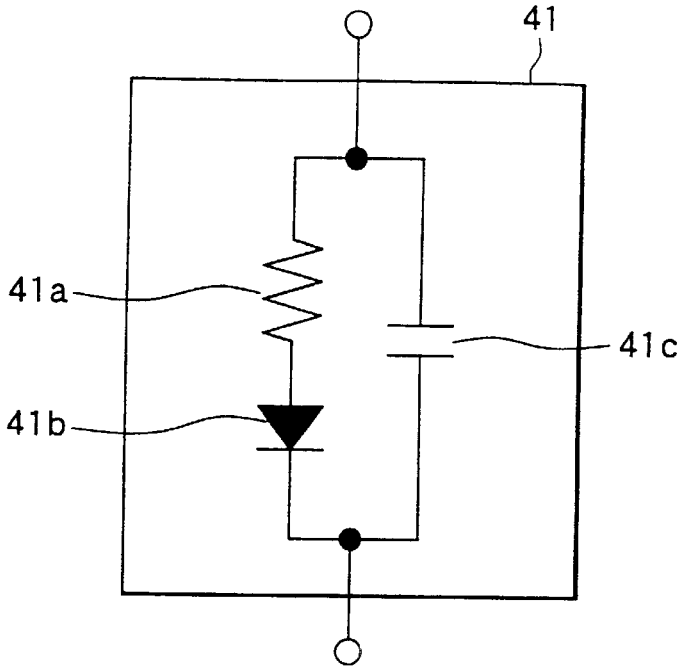
FIG. 14 is an equivalent circuit of a luminescent segment.

The segment 41 can be represented by an equivalent circuit shown in FIGS. 13 and 14, and the segments 42 and 43 can be expressed in the same manner. The equivalent circuit of the segment 41 includes a series circuit of an inner resistance 41*a* and a diode 41*b,* and a condenser 41*c* connected to the series circuit in parallel. Similarly, the equivalent circuit of the segment 42 consists of an inner resistance 42*a,* a diode 42*b* and a condenser 42*c*. The equivalent circuit of the segment 43 consists of an inner resistance 43*a*, a diode 43*b* and a condenser 43*c*. Wiring resistances 41*d*, 42*d* and 43*d* are connected in series to the equivalent circuits, respectively.

As shown in FIG. 13, a resistor 42*e* is connected in parallel to a series circuit formed by the segment 42 and the wiring resistance 42*d*. Similarly, a resistor 43*e* is connected in parallel to a series circuit formed by the segment 43 and the wiring resistance 43*d*. The resistors 42*e* and 43*e* are provided either in or outside the display panel 40. These resistors 42*e* and 43*e* are connected to supply an equal current density to all the segments 41, 42 and 43 to obtain an equal luminance among the segments, though the respective luminescent areas are different from one another. In other words, the resistors 42*e* and 43*e* are set, so that the current density to be supplied to each segment 41, 42 and 43 becomes equal. Since the luminescent areas of three segments 41, 42 and 43 are in the relation: S1=2S2=4S3, the current density in all the segments becomes equal if the respective currents are set in the relation: $I_1=2I_{21}=4I_{31}$.

More particularly, the resistance $R_{42e}$ of the resistor 42*e* is set to satisfy the following relation: $S2/S1=\frac{1}{2}=R_{42e}/(R_{42a}+R_{42d}+R_{42e})$, i.e., $R_{42e}=(R_{42a}+R_{42d})$, where $R_{42a}$ is the inner resistance of the segment 42 and $R_{42d}$ is the wiring resistance in that circuit. Similarly, the resistance $R_{43e}$ of the resistor 43*e* is set to satisfy the following relation: $S3/S1=\frac{1}{4}=R_{43e}/(R_{43a}+R_{43d}+R_{43e})$, i.e., $R_{43e}=(R_{43a}+R_{43c})/3$, where $R_{43a}$ is the inner resistance of the segment 43 and $R_{43d}$ is the wiring resistance in that circuit.

As shown in FIG. 13, the constant current "i" supplied from the driving circuit 50 to the circuit including the segment 42 is equally divided into $I_{21}$ and $I_{22}$, so that $I_{21}$ becomes $I_1/2$. The constant current "i" supplied from the driving circuit 50 to the circuit including the segment 43 is divided into $I_{31}$ and $I_{32}$, so that $I_{31}$ becomes $I_1/4$. Thus, the current density in all the segments 41, 42 and 43 becomes equal, and accordingly equal luminance is obtained from all the segments.

Since the constant current driving circuit 50 supplies the same constant current "i" to all three circuits, irrespective of the size of the respective luminescent areas, the driving circuit 50 can be made simple and in a cost-effective manner. Though the luminescent area ratio S1:S2:S3 is 1:(½):(¼) in the foregoing embodiment, that ratio can be arbitrarily selected. For example, S1:S2 may be 1:(1/n). In this case, the resistance $R_{42e}$ is set to $(R_{42a}+R_{42d})/(n-1)$. Since the wiring resistances 42*d* and 43*d* are relatively small, they may be neglected in setting the resistance values $R_{42e}$ and $R_{43e}$.

Though the equal current "i" is supplied to all the circuits from the driving circuit 50 in the fourth embodiment described above, it is also possible to supply different currents to respective sections if the luminescent segments having a similar luminescent area are grouped in a section and plural sections are formed. The parallel resistor arrangement in the fourth embodiment is also applicable to this case, too.

Figure 15:
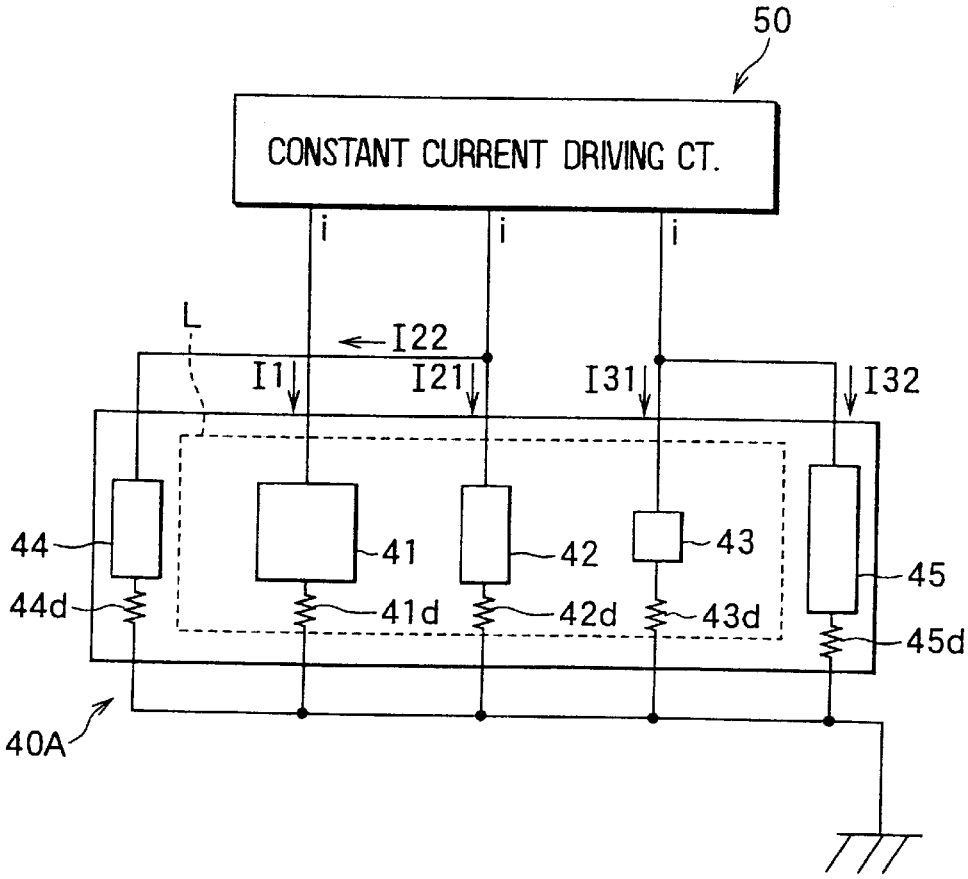
FIG. 15 is a circuit diagram showing a display device as a fifth embodiment of the present invention.

A fifth embodiment of the present invention is shown in FIG. 15. This embodiment is similar to the fourth embodiment shown in FIG. 13, except that the display panel 40 is replaced with a display panel 40A, in which parallel resistors 42*e* and 43*e* are replaced with auxiliary segments 44 and 45, respectively. The auxiliary segments 44 and 45 are disposed outside a display area L in which the segments 41, 42 and 43 are located. The auxiliary segments 44 and 45 can be represented by the same equivalent circuits as the segments 41, 42 and 43. A series circuit consisting of an inner resistance of the auxiliary segment 44 and a wiring resistance 44*d* is connected in parallel to the circuit including the segment 42 and corresponds to the resistor 42*e* of the fourth embodiment. Similarly, a series circuit consisting of an inner resistance of the auxiliary segment 45 and a wiring resistance 45*d* is connected in parallel to the circuit including the segment 43 and corresponds to the resistor 43*e* of the fourth embodiment.

The luminescent area of the auxiliary segment 44 is equal to the luminescent area S2 of the segment 42, and the luminescent area of the auxiliary segment 45 is three times the luminescent area S3 of the segment 43. In other words, the sum of the inner resistance of the auxiliary segment 44 and the wiring resistance 44d is equal to the resistance $R_{42e}$ of the resistor 42*e* of the fourth embodiment. The sum of the inner resistance of the segment 45 and the wiring resistance 45*d* is equal to the resistance $R_{43e}$ of the resistor 43*e* of the fourth embodiment.

The auxiliary segments 44, 45 and their wiring resistances 44*d*, 45*d* function in the same manner as the resistors 42*e* and 43*e* of the fourth embodiment. Thus, an equal current density is supplied to the segments 41, 42 and 43, achieving an equal luminance among those segments.

Figure 16:
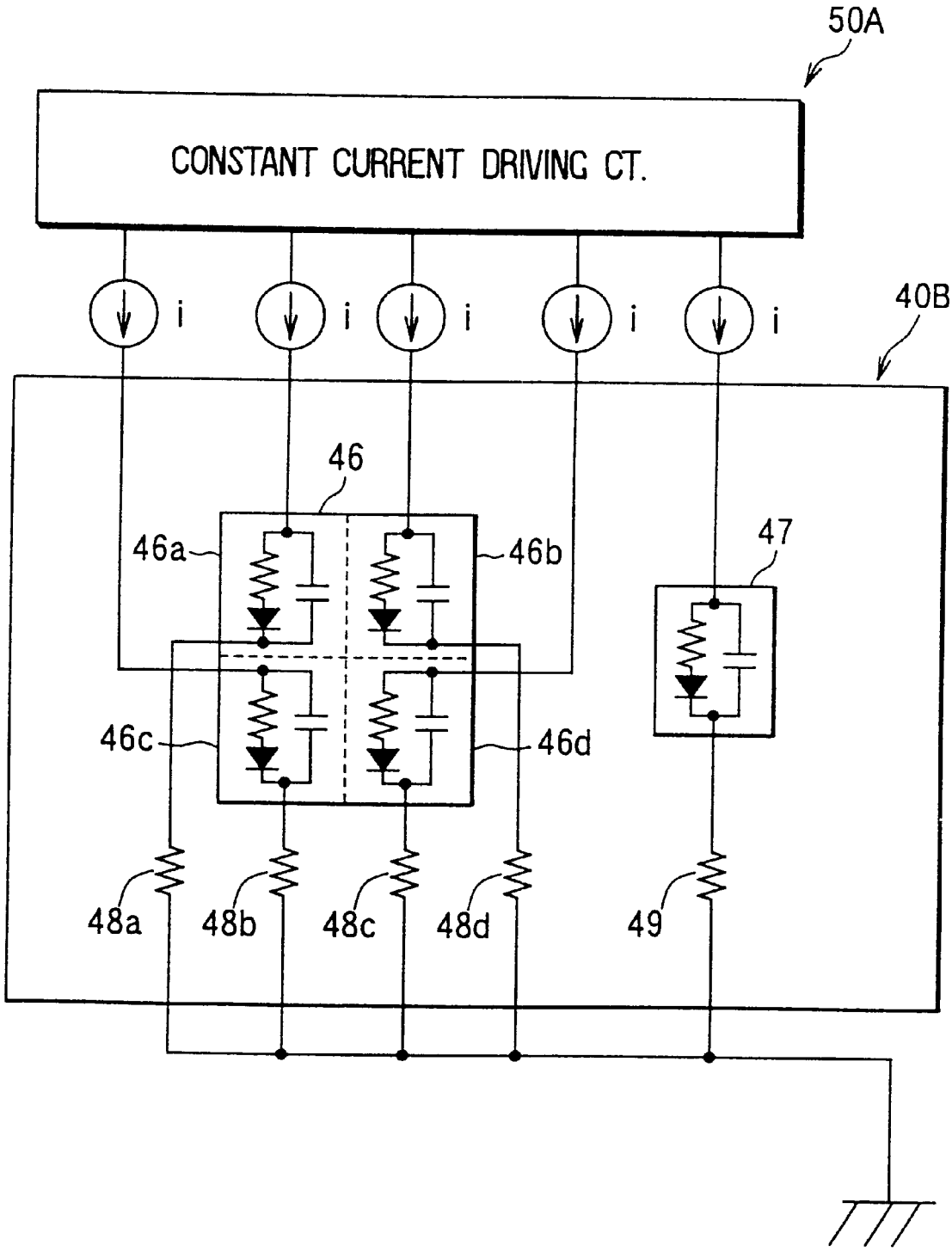
FIG. 16 is a circuit diagram showing a display device as a sixth embodiment of the present invention.

A sixth embodiment of the present invention will be described with reference to FIGS. 16–18. FIG. 16 shows a display device as the sixth embodiment of the present invention. The display device is composed of a segment-type organic electroluminescent display panel 40B and a constant current driving circuit 50A that drives the display panel.

The display panel 40B includes two luminescent segments 46 and 47, each being square-shaped. The segment 46 is divided into four square-shaped luminescent elements 46*a*–46*d*, and the segment 47 consists of a single luminescent element. Each luminescent element, 46*a*–46*d* and 47, has the same luminescent area and is represented by the same equivalent circuit as shown in FIG. 14. The shape of each element may be changed to other shapes such as rectangular or triangular shapes, as long as the luminescent area of all the elements is equal.

The constant current driving circuit 50A supplies an equal current "i" to each luminescent element. The supplied current "i" flows into respective luminescent elements and reaches the ground terminal through respective resistors 48*a*–48*d* and 49 connected in series to the respective elements.

Since each luminescent element has the equal luminescent area and the equal current is supplied to each element, the current density is all the same in each element. Therefore, an equal luminance is realized among all the luminescent elements 46*a*–46*d* and 47. Since the segment 46 is divided into four equal elements 46*a*–46*d*, it is not necessary to supply an amount of current 41 (four times the current "i" supplied to the segment 47) to the segment 46, thereby avoiding concentration of high current in the segment 46. Accordingly, the segment 46 is prevented from being damaged or broken down by over-current.

Figure 17:
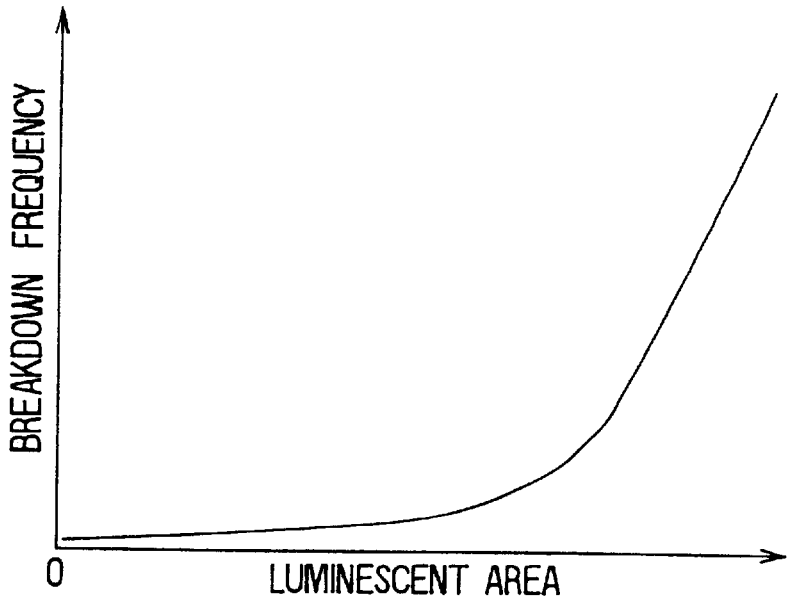
FIG. 17 is a graph showing a relation between a luminescent area and a breakdown frequency of a segment.
Figure 18:
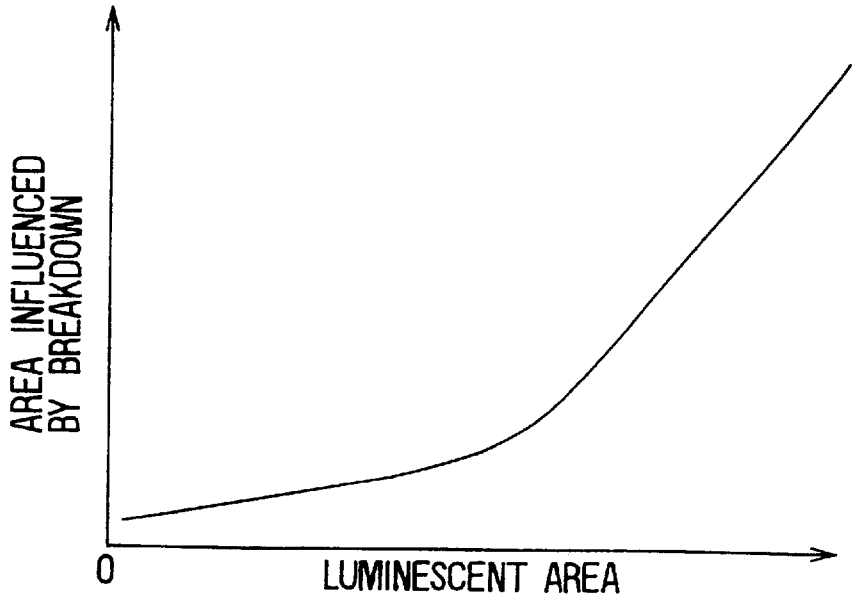
FIG. 18 is a graph showing a relation between a luminescent area and an area influenced by a breakdown.

Relation between a breakdown frequency of a segment (how often the segment is broken down) and a luminescent area is plotted in the graph of FIG. 17, and relation between an area influenced by the breakdown and a luminescent area is similarly plotted in the graph of FIG. 18. It is seen from the graphs that the breakdown frequency and the area influenced by the breakdown drastically increase when the luminescent area exceeds a certain level. Therefore, it is very effective to divide a large segment into small elements to prevent the breakdown of the segment.

The way of dividing the segment is not limited to the form of the above embodiment. For example, the segment 47 may be divided into two equal elements and the segment 46 into eight equal elements. Generally, if the segments are divided into plural elements each having the same luminescent area, the same advantage as in the sixth embodiment is obtained.

In all the embodiments described above, the current setters 32, 33, etc. may not be included in the integrated driving circuit 30, 50, etc., but they may be disposed separately from the driving circuit. Though the organic electroluminescent display panel is used as a display panel in the embodiments: described above, it may be replaced with other display panels having luminescent elements, the luminance of which is controlled according to current density.

While the present invention has been shown and described with reference to the foregoing preferred embodiments, it will be apparent to those skilled in the art that changes in form and detail may be made therein without departing from the scope of the invention as defined in the appended claims.

What is claimed is:

1. A display device comprising:

a display panel having a plurality of luminescent elements, luminance of which is determined according to a current density supplied thereto, the luminescent elements being grouped into a first luminescent section and a second luminescent section so that the luminescent elements having a luminescent area similar to a first size are grouped into the first luminescent section and the luminescent elements having a luminescent area similar to a second size are grouped into the second luminescent section;

first current supply means for supplying current to each luminescent element in the first luminescent section;

second current supply means for supplying current to each luminescent element in the second luminescent section;

first current setter means, connected to the first current supply means, for setting a first amount of current to be supplied to each luminescent element in the first section; and second current setter means, connected to the second current supply means, for setting a second amount of current to be supplied to each luminescent element in the second section, wherein:

the first and second amounts of current are set so that the current density supplied to each luminescent element in the first section and the current density supplied to each luminescent element in the second section become substantially equal.

2. The display device as in claim 1, wherein:

the first and second current setter means include respective resistors for respectively setting the amount of current.

3. The display device as in claim 1, wherein:

the first and second current setter means include respective voltage setters for respectively setting the amount of current.

4. The display device as in claim 1, wherein the first size and the second size differ from one another.

5. The display device as in claim 1, wherein each of the luminescent elements grouped into the first and the second luminescent sections comprises one of an individual luminescent element and a combination of luminescent elements.

6. A display device comprising:

a display panel having a plurality of luminescent elements, luminance of which is determined according to a current density supplied thereto, the luminescent elements being grouped into a first luminescent section and a second luminescent section so that a first group of the luminescent elements having a luminescent area similar to but slightly different from one another are grouped into the first luminescent section and a second group of the luminescent elements having a luminescent area different from one another are grouped into the second luminescent section;

first current supply means for supplying an equal amount of current to each luminescent element in the first luminescent section;

second current supply means for supplying respective amounts of current to the respective luminescent elements in the second luminescent section, the first and second current supply means setting the amount of current so that the current density, in each luminescent element becomes substantially the same; and duty ratio setting means, connected to the first current supply means, for setting a current supply duty ratio for each luminescent element in the first luminescent section according to the luminescent area thereof.

7. The display device as in claim 6, wherein:

the first and second current supply means respectively comprise a push-pull circuit consisting of two transistors.

8. A display device comprising:

a display panel having a plurality of luminescent segments, luminance of which is determined according to a current density supplied thereto, the luminescent segments having a luminescent area different from one another;

means for supplying current to each luminescent segment; and a resistor connected in parallel to the respective luminescent segments, the resistance of the resistor being set according to the luminescent area of the respective luminescent segments to equalize the current density in all the luminescent segments.

9. A display device comprising:

a display panel having a plurality of luminescent segments in a display region thereof, luminance of the luminescent segments being determined according to a current density supplied thereto, the luminescent segments having a luminescent area different from one another;

means for supplying current to respective luminescent segments; and an auxiliary luminescent segment connected in parallel to the respective luminescent segments, the auxiliary luminescent segment being disposed outside the display region, a luminescent area of the auxiliary luminescent segment being determined according to the luminescent area of the luminescent segment, to which the auxiliary luminescent segment is connected in parallel, to equalize the current density in all the luminescent segments.

* * * * *